United States Patent [19]

Crawford et al.

[11] 4,237,919

[45] Dec. 9, 1980

[54] DISHWASHER INLET AIR GAP

[75] Inventors: John G. Crawford, Louisville; John B. Taylor, Prospect, both of Ky.

[73] Assignee: General Electric Company, Louisville, Ky.

[21] Appl. No.: 46,982

[22] Filed: Jun. 8, 1979

[51] Int. Cl.[3] ..... F16K 24/00

[52] U.S. Cl. ..... 137/216; 134/186

[58] Field of Search ..... 134/56 D, 186; 137/216

[56] References Cited

U.S. PATENT DOCUMENTS

| | | | |
|---|---|---|---|
| 1,502,184 | 7/1924 | Gillies . | |
| 3,082,779 | 3/1963 | Jacobs | 134/186 X |
| 3,155,106 | 11/1964 | Baron . | |
| 3,183,923 | 5/1965 | Henrikson . | |
| 3,381,700 | 5/1968 | Frymark . | |
| 3,411,524 | 11/1968 | Raine et al. . | |
| 3,425,438 | 2/1969 | Suffron . | |
| 3,512,545 | 5/1970 | Weaver . | |
| 3,578,016 | 5/1971 | Kushner . | |
| 3,709,246 | 1/1973 | Kachergis . | |
| 3,929,149 | 12/1975 | Phillips . | |

*Primary Examiner*—Gerald A. Michalsky

*Attorney, Agent, or Firm*—H. Neil Houser; Radford M. Reams

[57] ABSTRACT

An antisiphon air gap arrangement is disclosed acting as a vacuum breaker for the water supply to a dishwasher, including a partitioned, bilevel standpipe extending upwardly from the dishwasher tub bottom. One section of the standpipe acts as a maximum flood level establishing overflow drain, while the other section extends to a level in the tub above the so-established flood level, and receives a fill tube from the inlet water supply valve. A domed cover mounted to the tub bottom extends over the partitioned standpipe to prevent escape of overspray from the dishwasher through the standpipe, while openings about the bottom enable fill water to pass into the tub. The fill tube passes through the other section of the partitioned standpipe opening with a clearance space, through which air from the exterior of the dishwasher is drawn whenever suction conditions in the house plumbing occur. The maximum flood level established by the level of the one standpipe section seals the domed cover openings so that only exterior air is drawn into the fill tube. The domed cover also prevents possibly contaminated overspray from the dishwasher interior from being drawn into the fill tube under suction conditions.

15 Claims, 5 Drawing Figures

DISHWASHER INLET AIR GAP

BACKGROUND DISCUSSION

This invention concerns air gap arrangements and more particularly antisiphon type air gap arrangements for the water supply inlet to dishwasher appliances. Most communities require vacuum breaking antisiphon devices to be incorporated in plumbing installations in the inlet to an appliance or other installation, if the supply tube supply line may become submerged in potentially contaminated water. This is since the water supply system may occasionally develop a negative pressure at the supply inlet, causing the contaminated water to be drawn into the water system of the community and endangering the health of those using the water supply.

One vacuum breaking or antisiphon arrangement which has been employed in the past in home appliances has been the provision of an air gap interposed in the supply system for the appliance. In the case of a dishwasher, such an air gap is typically provided by the supply tube communicating with the tub which is mounted exteriorly of the machine cabinet and provided with a funnel into which the fill water is directed under the control of the dishwasher fill valve. This arrangement is relatively complex and costly since long lengths of tubing may be required and the exterior mounting requires separate bracketry. This also creates potential leak points at the hose connections and the points where the supply tube passes into the tub bottom, as well as at the point of entry of any fasteners which must be employed.

The exterior mounting of the air gap arrangement is intended to prevent the possible induction of contaminated overspray in the machine interior, as well as to locate the air gap above "flood" level in the machine. That is, the maximum level reached in the machine after failure of all of the level controls designed into the machine.

Most dishwashers are protected by "failsafe" means whereby malfunction of the fill valve or other failures in the system do not result in overfilling of the machine and possible flooding thereof. However, the effectiveness of the antisiphon means is usually tested with such failsafe means defeated, allowing the machine to flood to whatever maximum level is reached in the machine with the safety arrangements defeated.

Accordingly, it is desirable that the air gap is located well above any potential flood level in the machine and exteriorly of the cabinet to insure that clean exterior air is drawn into the air gap when suction is applied to the supply line.

Accordingly, it is an object of the present invention to provide an air gap arrangement particularly adapted to dishwashers which eliminates the cost and potential maintenance problems of the conventional air gap arrangement described above.

It is a further object of the present invention to provide such air gap arrangements which insure the presence of an air gap between the fill tube and the water disposed in the machine under flood conditions.

It is still a further object of the present invention to provide such an air gap arrangement which prevents the possible induction of contaminated overspray from the machine interior into the supply line under suction conditions.

SUMMARY OF THE INVENTION

These and other objects of the present invention, which will become apparent upon a reading of the following specification and claims, are achieved by introducing the fill tube from the inlet water fill valve through an inlet standpipe upwardly extending from the tub bottom. The fill tube passes through the inlet standpipe with a clearance space therearound and thence directed downwardly over the terminal upper end of the standpipe. A flood level determining standpipe is also incorporated positioned at a level within the tub below the level of the inlet standpipe.

In the preferred embodiment, both of the standpipes are provided by a partitioned bilevel standpipe integrally formed in the dishwasher tub bottom.

Both inlet and flood level standpipes are enclosed by a domed cover mounted to the tub bottom, and having openings around its bottom enabling the fill water to pass into the dishwasher tub. The openings are below the level of the maximum flood conditions to seal the dome under flooded conditions, insuring that exterior air will be drawn around and through the clearance space between the fill tube and the inlet standpipe.

The domed covering precludes the escape of overspray through either standpipe and also insures that the potentially contaminated overspray within the machine interior will not be drawn into the fill tube under suction conditions.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
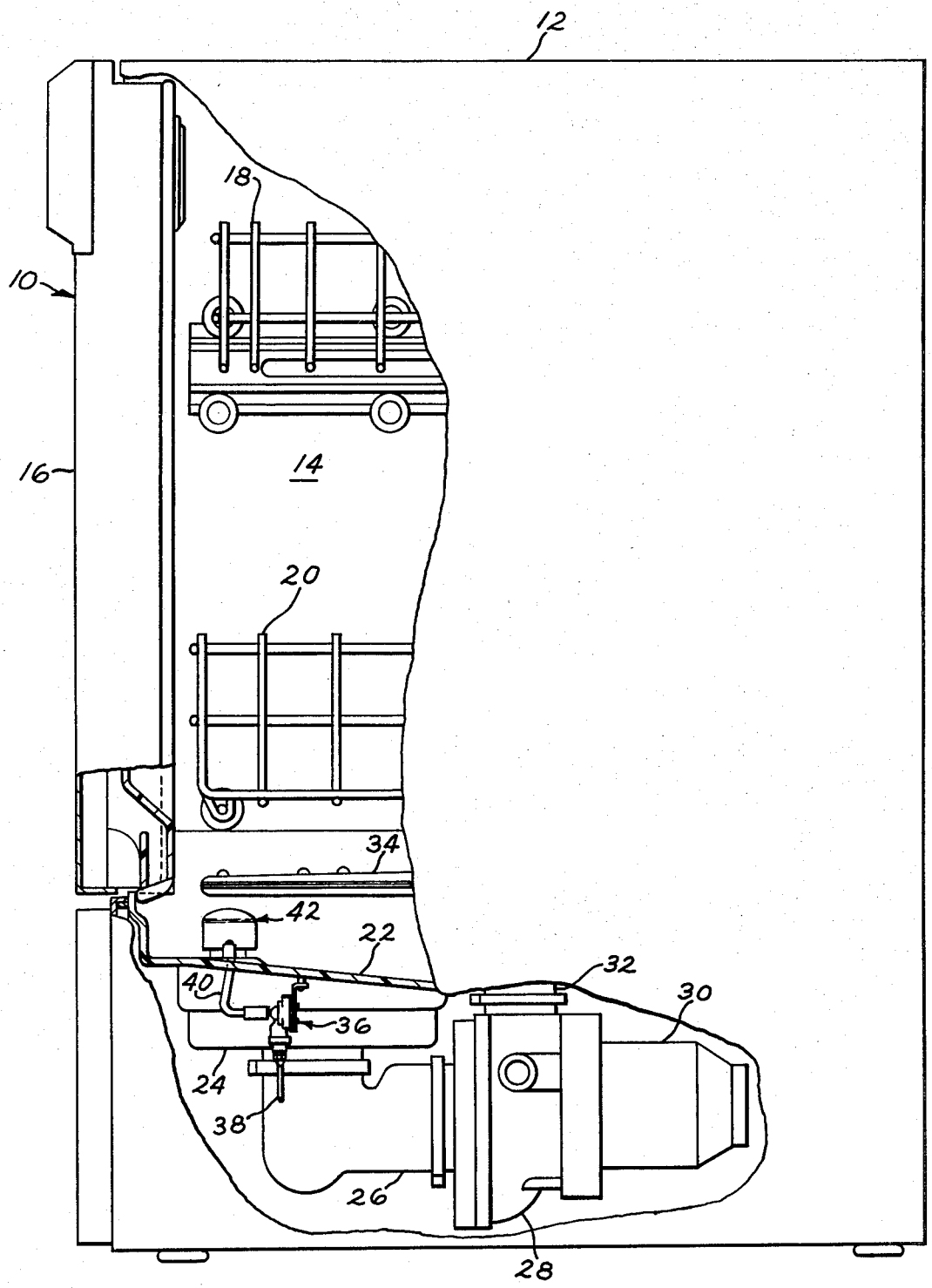
FIG. 1 is a side elevational view of a dishwasher incorporating the air gap arrangement according to the present invention with portions of the exterior cabinetry broken away to reveal the interior details of the machine, including the installation of the air gap arrangement.

Referring to the drawings and particularly to FIG. 1, the air gap arrangement according to the present invention is particularly adapted for incorporation in a dishwasher appliance 10 comprised of an outer cabinet 12 which defines an interior space 14 within which the dishware items are placed in order to be washed. A frontal access door 16 enables the upper rack 18 and lower rack 20 to be moved outwardly for loading.

Disposed within the interior space 14 is a tub 22 which holds the wash and rinse water introduced into the machine during the fill cycle, which water is collected in a sump 24 which directs the water to an inlet 26 of a circulation pump 28 driven by a motor 30. All of these components are mounted below the bottom of the tub 22.

The pump outlet 32 directs water under pressure into a rotary spray arm 34 which serves to wash the dishware items by means of a powerful cleaning spray directed at the items loaded into the upper rack 18 and lower rack 20.

According to the concept of the present invention, the supply of water to the dishwasher 10 is controlled by a fill valve 36 mounted beneath the tub 22 in communication with a plumbing hook-up line 38 connected into the house plumbing. A fill tube 40 directs the inlet water supply through an air gap arrangement indicated generally at 42 into the tub 22.

Figure 2:
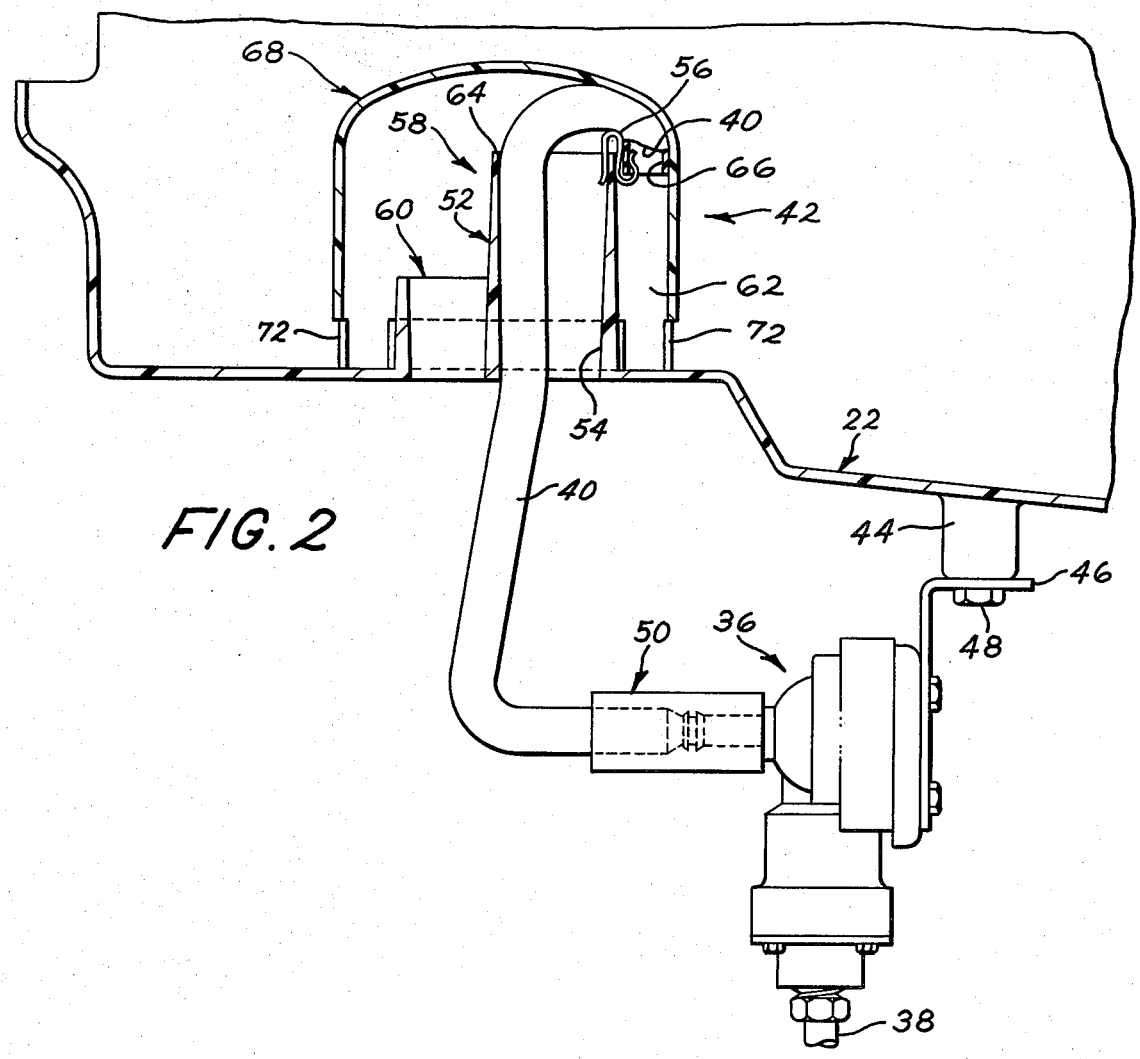
FIG. 2 is an enlarged partially sectional view of the air gap arrangement according to the present invention including the associated fill valve.
Figure 3:
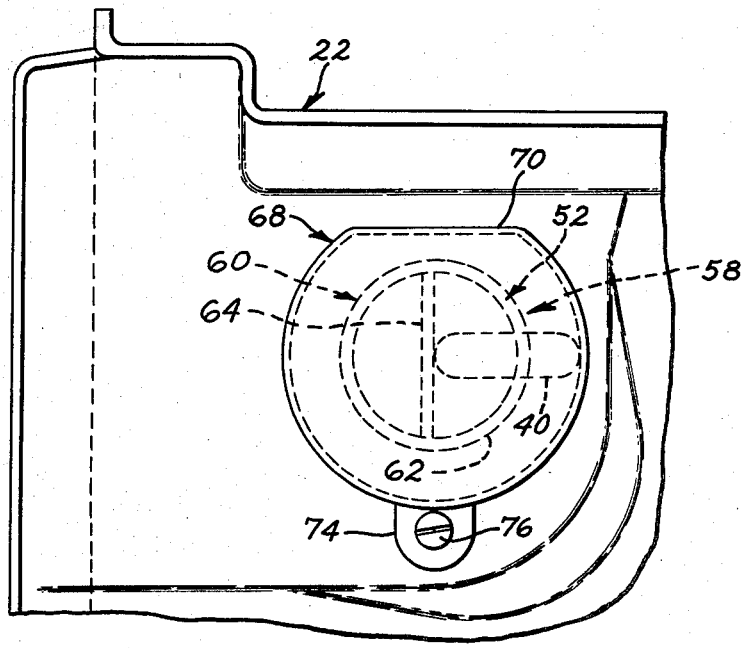
FIG. 3 is a plan view of the installation of the air gap arrangement according to the present invention depicted in FIGS. 1 and 2.

The details of this arrangement are best seen in FIGS. 2 and 3.

The fill valve 36 is mounted to a boss 44 molded into the molded plastic bottom of tub 22 and by means of a bracket 46 and threaded fastener 48. The fill valve 36 is of conventional design and is operated by means of the machine controls in well known fashion to cause opening of the fill valve 36 at appropriate points in the machine cycle, and flow of the proper volume of water to thereby be established through the fill tube 40, and thence into the interior of the machine. A coupling 50 joins the fill tube 40 to the outlet of the fill valve 36.

The air gap arrangement 42, according to the present invention, includes the concept of introducing the fill tube 40 through the interior of the inlet standpipe 52 which is integral with the bottom of tub 22 and extends upwardly from the tub bottom a short distance. The interior of the standpipe defines an entrance way through the tub bottom which is larger than the fill tube 40 to enable the fill tube 40 to be passed thereinto with a relatively large clearance space therebetween.

The terminal end of the fill tube 40 is formed over the top edge of the inlet standpipe 52 to be directed downwardly toward the bottom of the tub 22, secured in this position by means of a retainer 56.

According to the preferred embodiment of the present invention, the inlet standpipe 52 forms a part of a partitioned, bilevel standpipe 58 formed integrally with the bottom of tub 22, which includes in addition to the inlet standpipe 52, a flood level establishing standpipe 60.

The partitioned, bilevel standpipe 58, as best seen in FIG. 3, is provided by a molded circular protrusion, indicated at 62, which extends upwardly from the bottom of tub 22 and which is divided by means of a partition 64 to define the inlet standpipe 52 and the flood level establishing standpipe 60.

Flood inlet establishing standpipe 60 thus defines a second opening extending through the tub bottom.

The top of the flood level establishing standpipe 60 is at a level which is above the maximum water level encountered during normal operation of the machine, such that the flood level is only reached upon failure of the flood prevention devices (such as float level controls, etc.) which may be incorporated in the machine.

Thus, the maximum water level which will be reached within the tub 22 even with complete failure of all level control arrangements is below the level of the inlet standpipe 52, and also below the terminal portion 66 of the fill tube, which is positioned in close proximity to the top of the inlet standpipe 52 as shown in FIG. 2.

Accordingly, there is no possibility that the terminal end 66 will be submerged in the water within the tub 22 nor that water will pass out through the interior opening 54 rather than the flood level establishing standpipe 60.

Figure 5:
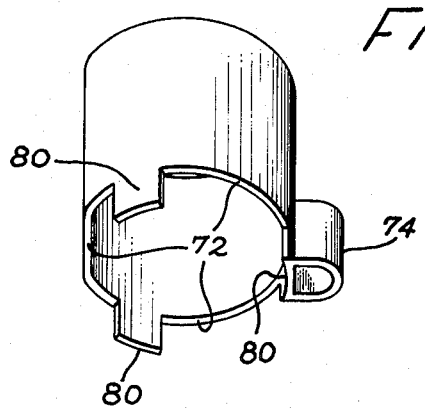
FIG. 5 is a perspective view of the domed cover depicted in FIG. 4 looking upwardly towards the bottom of the domed cover to reveal the bottom details thereof.

Covering the partitioned, bilevel standpipe 58 is a domed cover 68 which is generally cylindrical in shape (FIG. 2) with a flat (FIG. 3) for clearance in a particular installation adjacent a sidewall of the tub 22. The structure of domed cover 68 itself is best seen in the perspective view of FIG. 5.

The bottom of the domed cover 68 is mounted against the bottom of tub 22 and is formed with slotted openings 72 which communicate with the interior of the tub 22 enabling the fill water to pass out from beneath the domed cover 68 and into the tub during normal filling operations. The height of the slotted openings 72 must extend no higher than and are preferably below the top of the flood level establishing standpipe 60, such that whenever flood level conditions are encountered, the slotted openings 72 are sealed off from the interior of the domed cover 68 which insures that air will only enter the interior of the domed cover 68 through exterior opening 54 and thus if suction is applied to the fill tube 40, only exterior air will be drawn into the plumbing.

At the same time, the domed cover 68 shields the openings of the flood level establishing standpipe 60 and the inlet standpipe 52 to prevent escape of overspray during normal dishwasher cycles, causing leaks from the machine.

In addition, the presence of the domed cover 68 insures that the possibly contaminated overspray existing within the machine interior is similarly not drawn out into the fill tube 40 if suction is applied thereto. Rather, the majority of such air will continue to be drawn through the clearance space between the interior opening 54 and the fill tube 40. Any slight inflow to the slotted openings 72 under nonflood conditions will not carry possibly contaminated overspray from the machine interior.

Figure 4:
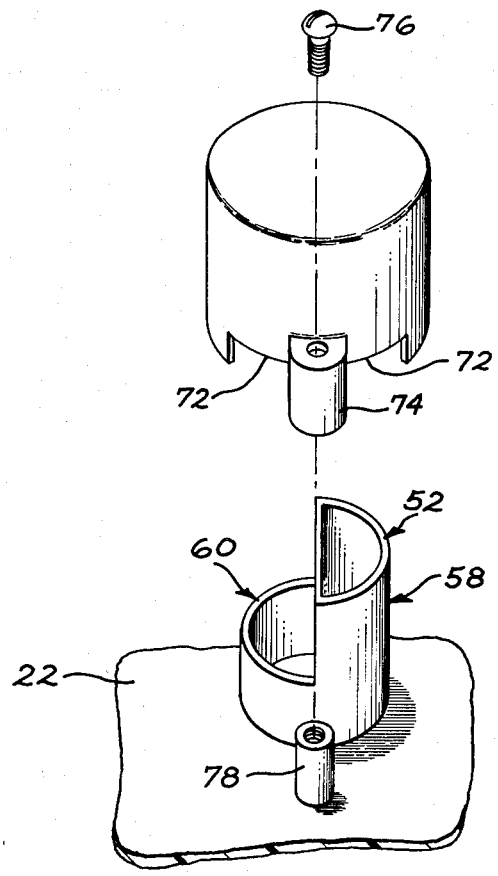
FIG. 4 is an exploded perspective view of the domed cover, fastener and partitional bilevel standpipe assembly included in the air gap arrangement according to the present invention depicted in FIGS. 1 through 3.

The domed cover 68 is mounted to the bottom by a molded-in tab 74 (FIGS. 4 and 5) and a threaded fastener 76 received within a boss 78 molded into the tub interior adjacent the partitioned, bilevel standpipe 58. Tab 74 is molded into one of a series of tabs 80 which extend axially from the bottom of domed cover 68, with the spaces therebetween defining the slotted openings 72 through which the fill water passes in order to enter the tub 22.

Accordingly, it can be seen that the objects of the invention are achieved by this arrangement in that the fill valve can be mounted directly adjacent to the point whereat the fill tube enters the tub, and no connections are required since the standpipe opening is integrally formed with the bottom of tub 22 to provide a much lower cost installation due to the elimination of fasteners, long tubing lengths, clamps, etc., and also the potential maintenance problems created by the leak paths introduced by the above-described arrangement.

In addition, the air gap is maintained even under maximum flood conditions by the limiting of the maximum water level within the machine by the flood level establishing standpipe 60, to be below the level of the terminal end 66 of the fill tube 40 and the level of the inlet standpipe 52.

The domed cover 68 creates sealing of the interior of the dome under flood conditions and thus insures the entrance of only exterior uncontaminated air into the fill tube in the event of suction being applied to the fill tube 40. The domed cover 68 also insures that the overspray does not leak from the machine and precludes the entrance of potentially contaminated overspray into the suction tube during suction conditions, even if flood level conditions do not exist within the machine.

The embodiments of the invention in which an exclusive property or privilege is claimed are defined as follows:

1. An air gap arrangement for providing an antisiphon vacuum breaker interposed in a plumbing supply water line adapted to direct an inflow of water to a tub receiving said inflow of water, said air gap arrangement comprising:

an inlet standpipe extending up from the bottom of said tub;

a fill tube and valve means controllably creating flow from said plumbing water supply line, the terminal end of said fill tube extending into the interior of said tub in close proximity to the top of said inlet standpipe and directing inflow of water into said tub;

a flood level establishing standpipe extending up from the bottom of said tub and having an opening passing through the bottom of said tub, the top of said flood level establishing standpipe at a level below the top of said fill standpipe and the terminal end of said fill tube, whereby the flood level in said tub defined by the top of said flood level standpipe is below the level of said terminal end of said tube, whereby an air gap is maintained between said terminal end of said tube and the level of water in said tub at said flood level.

2. The air gap arrangement according to claim 1 wherein said fill tube extends up through said inlet standpipe into the interior of said tub.

3. The air gap arrangement according to claim 2 wherein said inlet standpipe and said flood level establishing standpipe are integrally formed with said tub.

4. The air gap arrangement according to claim 2 further including a cover enclosing said inlet standpipe mounted against said tub bottom and including openings adjacent said tub bottom allowing outflow of water flowing in through said fill tube into said tub.

5. The air gap arrangement according to claim 4 wherein a clearance space is provided between said fill tube and the interior of said inlet standpipe, whereby air flow may be drawn into said fill tube from below said tub.

6. The air gap arrangement according to claim 5 wherein said openings formed in said cover are located at a level below the top of said flood level establishing standpipe, whereby upon reaching a flood level condition in said tub, said openings are sealed and said air flow into said fill tube originates entirely through said clearance space between said fill tube and said supply inlet standpipe.

7. The air gap arrangement according to claim 2 wherein said inlet standpipe and said flood level establishing standpipe are provided by a partitioned, bilevel standpipe comprised of an upwardly extending standpipe integrally formed with said tub having a partition formed therein and defining in part said inlet standpipe and said flood level establishing standpipe.

8. In a dishwasher including a dishwasher cabinet defining an interior space wherein dishware items are washed, said interior space being defined in part by a tub, a fill arrangement comprising:

a fill valve adapted to be connected to supply plumbing;

a fill tube connected to said fill valve and adapted to receive water inflow from said fill valve upon opening of said fill valve;

an inlet standpipe extending upwardly from the bottom of said dishwasher tub having an opening formed therein extending through said tub bottom, said fill tube extending through said inlet standpipe and having a terminal end portion directed over the top of said inlet standpipe;

whereby said dishwasher may be filled with supply water through said tub bottom.

9. The fill arrangement according to claim 8 wherein said inlet standpipe is integrally formed with said tub bottom.

10. The fill arrangement according to claim 8 further including a flood level establishing standpipe extending upwardly from said dishwasher tub bottom and having an opening passing therethrough, the top of said flood level establishing standpipe being below the top of said inlet standpipe and said terminal portion end of said fill tube, whereby said water level in said tub at flood condition is below said terminal level of said fill tube, whereby an air gap is established therebetween at said flood level condition in said dishwasher.

11. The fill arrangement according to claim 10 wherein said inlet standpipe and said flood level establishing standpipe are provided by a single upwardly extending bilevel standpipe formed in said tub bottom and having an internal partition dividing said standpipe into different sections, one of which defining said inlet standpipe and the other of which defining said flood level establishing standpipe.

12. The fill arrangement according to claim 11 further including a cover extending over said bilevel standpipe and mounted to the bottom of said tub, said cover including at least one opening formed adjacent said tub bottom, said opening extending no higher than the top of said flood level establishing standpipe, whereby outflow of water through said opening from said fill tube into said tub is permitted and whereby under flood conditions the water level in said tub covers said opening permitting only air exterior to said dishwasher tub to enter said cover and said fill tube upon development of a suction condition in said fill tube.

13. The fill arrangment according to claim 8 wherein said fill valve is mounted below said tub adjacent said inlet standpipe.

14. The fill arrangement according to claim 8 further including a cover extending over said inlet standpipe and mounted to the bottom of said tub, said cover including at least one opening formed adjacent said tub bottom allowing outflow from said cover of water introduced therein through said fill tube.

15. The fill arrangement according to claim 14 wherein said fill tube is smaller than said inlet standpipe to define a clearance space therebetween, whereby air flow into said cover and into said fill inlet fill tube upon development of a suction condition in said fill tube is accommodated, whereby said air flow from the exterior of said dishwasher may occur.

* * * * *